US008413325B2

(12) United States Patent
Finke et al.

(10) Patent No.: US 8,413,325 B2
(45) Date of Patent: Apr. 9, 2013

(54) METHOD OF FORMING CONNECTOR WITH ISOLATED CONDUCTIVE PATHS

(75) Inventors: Michael Dewayne Finke, Cypress, TX (US); Jesse Kevin Hensarling, Cleveland, TX (US); Randal Thomas Beste, Houston, TX (US); Charles Pence Burke, Magnolia, TX (US); James Neal Spence, Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/165,314

(22) Filed: Jun. 21, 2011

(65) Prior Publication Data

US 2011/0252643 A1 Oct. 20, 2011

Related U.S. Application Data

(62) Division of application No. 11/175,018, filed on Jul. 5, 2005, now abandoned.

(60) Provisional application No. 60/653,720, filed on Feb. 17, 2005.

(51) Int. Cl.
*H01R 43/00* (2006.01)

(52) U.S. Cl. ..... 29/883; 29/876; 29/879; 29/882

(58) Field of Classification Search ..... 29/883, 29/876, 879, 882; 285/342, 348; 439/190, 439/194, 271, 448, 506, 578, 581, 607.41, 439/700

See application file for complete search history.

(56) References Cited

U.S. PATENT DOCUMENTS

| | | | | |
|---|---|---|---|---|
| 2,750,569 | A | 6/1956 | Moon et al. | |
| 4,173,384 | A | 11/1979 | Phillips | |
| 4,426,127 | A | 1/1984 | Kubota | |
| 4,553,807 | A | 11/1985 | Cane | |
| 5,131,464 | A | 7/1992 | Lenhart et al. | |
| 5,358,418 | A | 10/1994 | Carmichael | |
| 5,645,438 | A | 7/1997 | Cairns | |
| 5,669,637 | A * | 9/1997 | Chitty et al. | 285/342 |
| 6,773,312 | B2 | 8/2004 | Bauer et al. | |
| 6,948,976 | B2 * | 9/2005 | Goodwin et al. | 439/578 |
| 2006/0183373 | A1 | 8/2006 | Finke et al. | |
| 2010/0087092 | A1 | 4/2010 | Finke et al. | |

OTHER PUBLICATIONS

"U.S. Appl. No. 11/175,018, Response filed Nov. 20, 2007 to Non-Final Office Action mailed May 30, 2007", 10 pgs.
"U.S. Appl. No. 11/175,018, Advisory Action mailed Feb. 23, 2007", 3 pgs.

(Continued)

*Primary Examiner* — Thiem Phan
(74) *Attorney, Agent, or Firm* — Schwegman Lundberg & Woessner, P.A.; Alan Bryson

(57) ABSTRACT

A method of forming a connector with isolated conductive paths can include using a flexible member. An example of a method of forming a connector with isolated conductive paths can include forming a bulkhead assembly including two-or-more isolated bulkhead conductive paths. A non-bulkhead assembly can be formed including two-or-more isolated non-bulkhead conductive paths. A flexible coupling can be formed between each of the two-or-more isolated bulkhead conductive paths and each of the two-or-more isolated non-bulkhead conductive paths to form a flexible connector. Another example method can include assembling, at least partially, a connector having a groove, securing a flexible member in the groove, and flowing solder into the flexible member in the groove. Additional methods and associated apparatus and systems are disclosed.

10 Claims, 5 Drawing Sheets

OTHER PUBLICATIONS

"U.S. Appl. No. 11/175,018, Appeal Brief filed Mar. 19, 2009", 20 pgs.
"U.S. Appl. No. 11/175,018, Examiner's Answer mailed Sep. 9, 2009", 7 pgs.
"U.S. Appl. No. 11/175,018, Final Office Action mailed Feb. 19, 2008", 8 pgs.
"U.S. Appl. No. 11/175,018, Final Office Action mailed Aug. 29, 2006", 7 pgs.
"U.S. Appl. No. 11/175,018, Non Final Office Action mailed Mar. 20, 2006", 8 pgs.
"U.S. Appl. No. 11/175,018, Non Final Office Action mailed May 30, 2007", 7 pgs.
"U.S. Appl. No. 11/175,018, Notice of Appeal filed Aug. 19, 2008", 1 pg.
"U.S. Appl. No. 11/175,018, Response filed Jan. 25, 2007 to Final Office Action mailed Aug. 29, 2006", 9 pgs.
"U.S. Appl. No. 11/175,018, Response filed Jun. 20, 2006 to Non Final Office Action mailed Mar. 20, 2006", 9 pgs.
"U.S. Appl. No. 12/633,274, Non-Final Office Action mailed Jul. 21, 2010", 9 pgs.
"U.S. Appl. No. 12/633,274, Notice of Allowance mailed Mar. 15, 2011", 7 pgs.
"U.S. Appl. No. 12/633,274, Response filed Dec. 21, 2010 to Non Final Office Action mailed Jul. 21, 2010", 10 pgs.
"U.S. Appl. No. 12/633,274, Supplemental Notice of Allowability mailed Apr. 26, 2011", 2 pgs.
"Bulkhead Female Connectors", [online]. (c) 1999 Kemlon Products and Development. [retrieved Jan. 11, 2010]. Retrieved from the Internet: <URL: http://www.kemlon.com/catalogs/duoseel/females.htm>, (1999), 1 pg.
"U.S. Appl. No. 11/175,018, Appeal Decision mailed Jul. 30, 2012", 6 pgs.

* cited by examiner

METHOD OF FORMING CONNECTOR WITH ISOLATED CONDUCTIVE PATHS

RELATED APPLICATION

This application is a divisional of U.S. Ser. No. 11/175,018, filed Jul. 5, 2005, which claims the benefit of U.S. Provisional Application Ser. No. 60/653,720 filed Feb. 17, 2005, which applications are incorporated herein by reference in their entireties.

FIELD

The subject matter relates to connectors, and more particularly, to connectors that include isolated conductive paths.

BACKGROUND

Connectors can provide electrical coupling between systems. For example, in a system for capturing information in an oil well, a connector can provide a path for data, such as acoustic data, between electronic modules, such as a data acquisition module, and a data communication module. Connectors used in these applications, or other applications deployed in harsh environments, fail because the connectors are unable to operate when exposed to the heat, pressure, or mechanical stresses encountered in the environment. Failure modes include both mechanical and electrical. Mechanical failures include melting and mechanical distortion. Electrical failures include contact failures due to cyclic mechanical stress. In addition to contributing to a complete system failure, a harsh environment can also cause degradation in the electrical performance or intermittent failures in a connector.

DESCRIPTION

Figure 1:
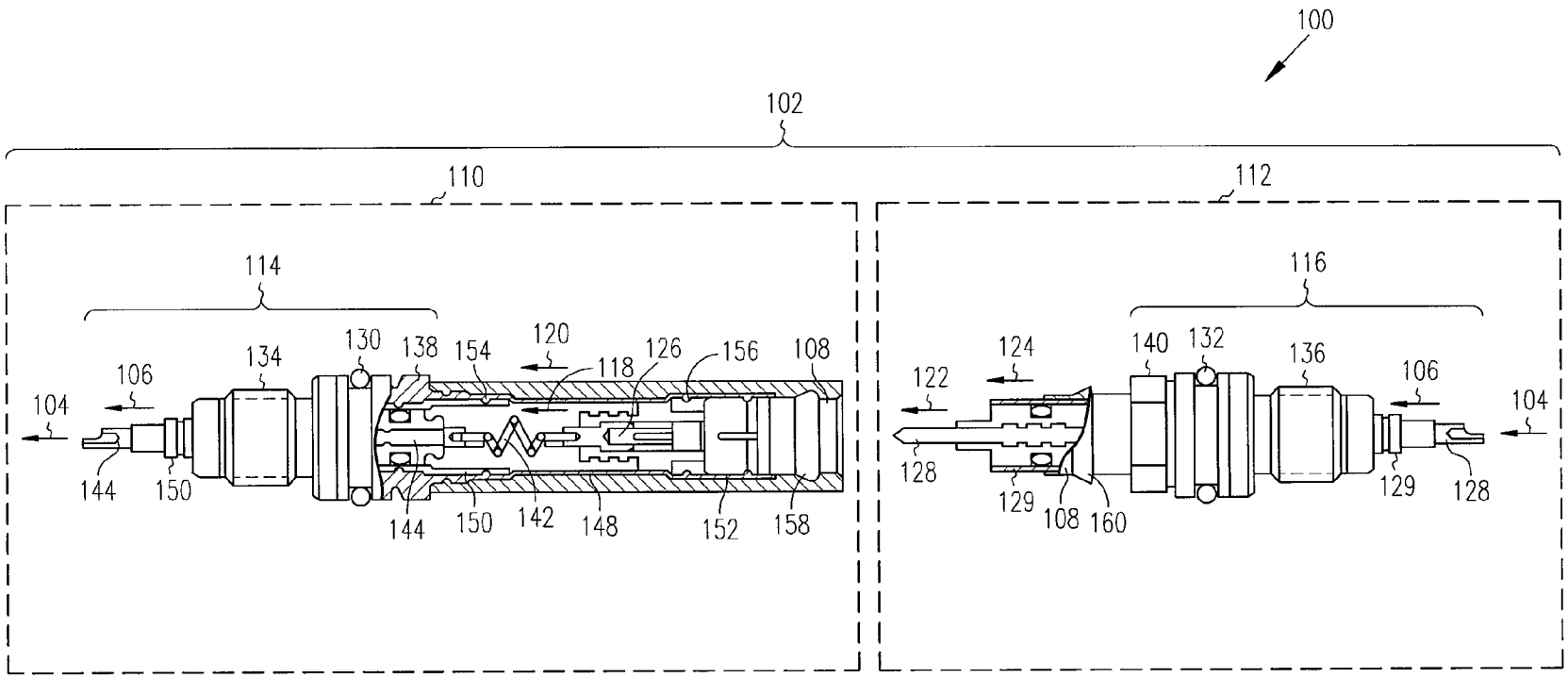
FIG. 1 is a partially cut-away side view of an apparatus including a pair of connectors, conductive paths (shown in more detail in FIG. 2), and a shroud, in accordance with some embodiments of the present invention.

In the following description of some embodiments of the present invention, reference is made to the accompanying drawings which form a part hereof, and in which are shown, by way of illustration, specific embodiments of the present invention which may be practiced. In the drawings, like numerals describe substantially similar components throughout the several views. These embodiments are described in sufficient detail to enable those skilled in the art to practice the present invention. Other embodiments may be utilized and structural, logical, and electrical changes may be made without departing from the scope of the present invention. The following detailed description is not to be taken in a limiting sense, and the scope of the present invention is defined only by the appended claims, along with the full scope of equivalents to which such claims are entitled.

FIG. 1 is a partially cut-away side view of an apparatus 100 including a pair of connectors 102, conductive paths 104 and 106 (shown in more detail in FIG. 2), and a shroud 108 in accordance with some embodiments of the present invention. The pair of connectors 102 includes connectors 110 and 112. The connector 110 includes a bulkhead 114. The connector 112 includes a bulkhead 116. The connector 110 includes conductive paths 118 and 120. The connector 112 includes conductive paths 122 and 124.

The pair of connectors 102 are coupled to together electrically when one of the conductive paths 118 or 120 in the connector 110 is electrically coupled to one of the conductive paths 122 or 124 in the connector 112. When the pair of connectors 102 are coupled together electrically, the conductive path 104 of the pair of connectors 102 includes the conductive path 118 of the connector 110 and the conductive path 122 of the connector 112. In addition, when the pair of connectors 102 are coupled together electrically, the conductive path 106 of the pair of connectors 102 includes the conductive path 120 of the connector 110 and the conductive path 124 of the connector 112. (The conductive paths 118, 120, 122, and 124 are shown in more detail in FIG. 2.) Furthermore, when the pair of connectors 102 are coupled together electrically, the shroud 108 encompasses at least a portion of each of the pair of connectors 102 located between the bulkheads 114 and 116, and the shroud 108 is disposed about the pair of connectors 102.

The pair of connectors 102 includes the connectors 110 and 112. In some embodiments, the connector 110 is a female connector and the connector 112 is a male connector. The connector 110 includes a socket 126 to receive a pin 128 when the connectors 110 and 112 are coupled together electrically. The connector 110 includes the substantially rigid member 152 to receive a substantially rigid member 129 of the connector 112 when the connectors 110 and 112 are coupled together electrically.

The bulkheads 114 and 116, in some embodiments, have a high-temperature and high-pressure rating. An exemplary high temperature rating is about 400degrees Fahrenheit. An exemplary high pressure rating is about 25,000 pounds per square inch. The bulkheads 114 and 116 include O-rings 130 and 132, respectively. An exemplary O-ring is a one-piece molded elastomeric seal with a circular cross-section that seals by distortion of its resilient elastic compound. Those skilled in the art will appreciate that the O-rings 130 and 132 suitable for use in connection with the bulkheads 114 and 116 in the apparatus 100 can be formed from a variety of materials. A fluorocarbon is one exemplary material suitable for use in fabrication of the O-rings 130 and 132.

The bulkheads 114 and 116, in some embodiments, include a high strength material. Beryllium copper is high strength material suitable for use in connection with the fabrication of the bulkheads 114 and 116. The bulkheads 114 and 116, in some embodiments, include threads 134 and 136, respectively. Non-galling materials are suitable for use in connection with the fabrication of threaded bulkheads. Beryllium copper is one non-galling material suitable for use in connection with the fabrication of the bulkheads 114 and 116.

The bulkheads 114 and 116 include torque members 138 and 140, respectively. The torque members 138 and 140 provide an attachment site for delivering torque to the bulkheads 114 and 116 when they are being inserted and tightened in a threaded receptacle (not shown) or mount (not shown). In some embodiments, the torque members 138 and 140 have hex shape (not shown). The torque members 138 and 140 are formed from an insulative material. An exemplary insulative material suitable for use in fabrication of the torque members 138 and 140 is polyetherether-ketone (PEEK). PEEK is a thermoplastic and can be used continuously to 480° F. (250° C.) and in hot water or steam without permanent loss in physical properties. Those skilled in the art will appreciate that fabrication of the torque members 138 and 140 can include machining molded PEEK to provide the desired geometry for the attachment site of the torque members 138 and 140.

The conductive paths 104 and 106 provide two paths for electrical signals to pass through the connectors 110 and 112, respectively. The conductive path 104 includes the conductive paths 118 and 122 in the pair of connectors 102. The conductive path 106 includes the conductive paths 120 and 124 in the pair of connectors 102. The conductive paths 118, 120, 122, and 124 are not limited to being fabricated from a particular material. Any conductive material is suitable for use in connection with the fabrication of the conductive paths 118, 120, 122, and 124 in the connectors 110 and 112. Metals are conductive materials suitable for use in connection with the fabrication of the conductive paths 118, 120, 122, and 124. One exemplary conductive materials suitable for use in connection with the fabrication of the conductive paths 118, 120, 122, and 124 is beryllium copper. In some embodiments, the material selected for the conductive paths 118, 120, 122, and 124 is coated with gold.

The conductive path 118 in the connector 110 includes a flexible member 142 located between a substantially rigid member 144 and the socket 126. The flexible member 142 is not limited to being formed from a particular flexible structure or a particular material. The flexible member 142, in some embodiments, includes a conductive spring formed from beryllium copper coated with gold. The flexible member 142 is not limited to being coupled to the substantially rigid member 144 and the socket 126 using a particular method. The flexible member 142, in some embodiments, is coupled to the substantially rigid member 144 by crimping. The flexible member 142, in some embodiments, is coupled to the substantially rigid member 144 by soldering. The flexible member 142, in some embodiments, is coupled to the socket 126 by crimping. The flexible member 142, in some embodiments, is coupled to the socket 126 by soldering.

The conductive path 120 in the connector 110 includes a flexible member 148 located between two substantially rigid members 150 and 152. The flexible member 148 is not limited to being formed from a particular flexible structure or a particular material. The flexible member 148, in some embodiments, includes a conductive braided member formed from tin coated copper. The flexible member 148 is not limited to being coupled to the two substantially rigid members 150 and 152 using a particular method. The flexible member 148, in some embodiments, is coupled to one of the two substantially rigid members 150 and 152 by soldering. The soldering is confined substantially to grooves 154 and 156 formed in each of the two substantially rigid members 150 and 152 to which the flexible member 148 is secured by a wrapped wire before soldering. A detailed description of a process for securing the flexible member 148 to the rigid members 150 and 152 is provided below in the description of FIG. 5.

The shroud 108 protects the pair of connectors 102 and the conductive paths 104 and 106 at the interface or junction between the connectors 110 and 112 when the pair of connectors 102 are coupled together electrically. The shroud 108 is formed from a flexible, insulative material. In some embodiments, the shroud 108 is formed from a fluorocarbon. Nubs 158 and 160 are bumps or other distortions on a substantially uniform surface of the connectors 110 and 112, respectively, that prevent sliding of the shroud 108. In some embodiments, the shroud 108 is held in place, at least partially, by the nubs 158 and 160. In some embodiments, hydrostatic pressure may be sufficient to hold the shroud 108 in place during operation of the pair of connectors 102. Thus, the nubs 158 and 160 may not be required. The shroud 108 provides a hermetic seal at the interface or junction between the pair of connectors 102.

Figure 2:
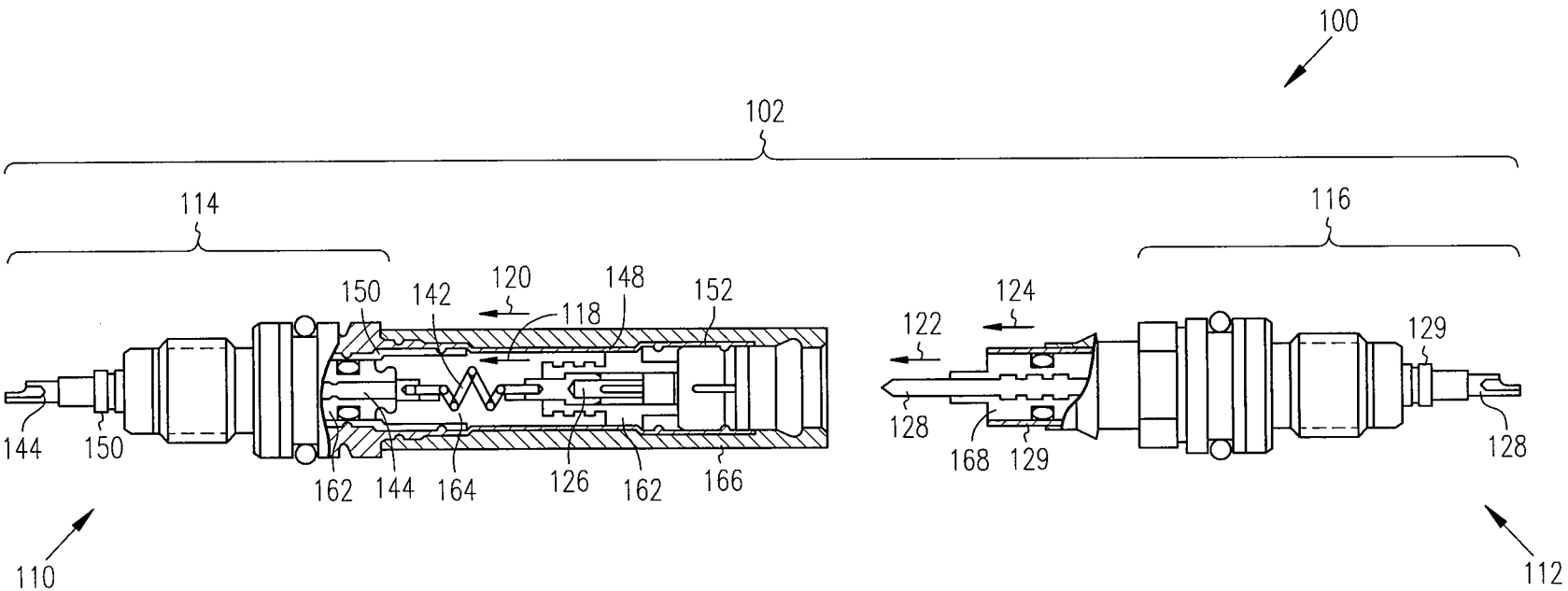
FIG. 2 is a partially cut-away side view of the apparatus shown in FIG. 1 including the pair of connectors and the conductive paths, in accordance with some embodiments of the present invention.

FIG. 2 is a partially cut-away side view of the apparatus 100 shown in FIG. 1 including the pair of connectors 102 and the conductive paths 118, 120, 122, and 124 in accordance with some embodiments of the present invention. The conductive path 118 includes the socket 126, the flexible member 142, and the substantially rigid member 144. The flexible member 142 couples the socket 126 to the substantially rigid member 144. The substantially rigid member 144 provides a conductive path from the flexible member 142 through the bulkhead 114. The conductive path 120 includes the flexible member 148 and the two substantially rigid members 150 and 152. The flexible member 148 couples the two substantially rigid members 150 and 152 together. The substantially rigid member 150 extends through the bulkhead 114. The conductive path 122 includes the pin 128. The pin 128 extends through the bulkhead 116. The conductive path 124 includes the substantially rigid member 129. The substantially rigid member 129 extends through the bulkhead 116.

The conductive path 118 includes the socket 126, the flexible member 142, and the substantially rigid member 144. The socket 126 and the substantially rigid member 144 are substantially surrounded by an insulative material 162, such as PEEK. The flexible member 142 is substantially surrounded by a flexible, insulative material 164, such as rubber.

The conductive path 120 includes the flexible member 148. The flexible member 148 substantially surrounds the flexible, insulative material 164. A flexible sleeve 166 substantially surrounds the flexible member 148. The flexible sleeve 166 is not limited to being fabricated from a particular material. In some embodiments, the flexible sleeve 166 is fabricated from rubber.

Thus, flexibility in the connector 110 is achieved by substantially surrounding the flexible member 142 with a flexible, insulative material 164, substantially surrounding the flexible, insulative material 164 with the flexible member 148, and substantially surrounding the flexible member 148 with the flexible sleeve 166.

The connector 112 includes the pin 128 and the substantially rigid member 129. The pin 128 and the substantially rigid member 129 are separated by an insulative material 168, such as PEEK.

Figure 3:
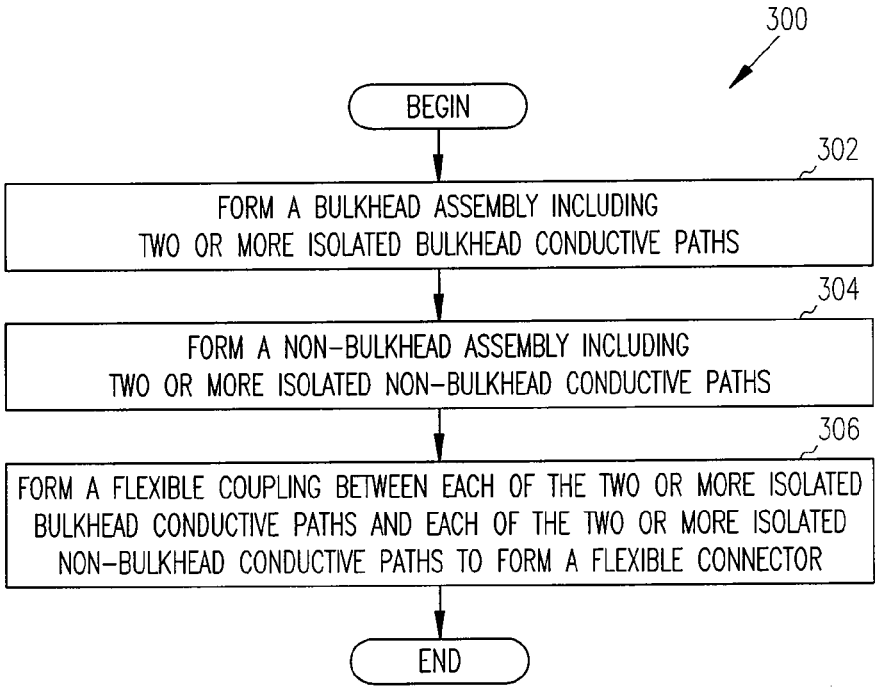
FIG. 3 is a flow diagram of a method of forming the flexible connector, shown in FIG. 1, in accordance with some embodiments of the present invention.

FIG. 3 is a flow diagram of a method 300 of forming the flexible connector 110, shown in FIG. 1 in accordance with some embodiments of the present invention. The method 300 includes forming a bulkhead assembly including two-or-more isolated bulkhead conductive paths (block 302), forming a non-bulkhead assembly including two-or-more isolated non-bulkhead conductive paths (block 304), and forming a flexible coupling between each of the two-or-more isolated bulkhead conductive paths and each of the two-or-more isolated non-bulkhead conductive paths to form a flexible connector (block 306).

In some embodiments, forming the bulkhead assembly including the two-or-more isolated bulkhead conductive paths includes forming a first assembly including one of the two-or-more isolated bulkhead conductive paths, forming a second assembly including one of the two-or-more isolated bulkhead conductive paths, and assembling the first and second assembly. In the first assembly, the one of the two-or-more isolated bulkhead conductive paths is an inner path. In the second assembly, the one of the two-or-more isolated bulkhead conductive paths is an outer path.

In some embodiments, forming the first assembly includes injection molding an insulative material around the inner conductive path to form an inner conductive path assembly. Further, forming the first assembly includes injection molding an insulative material around the outer conductive path to form an outer conductive path assembly. Still further, forming the first assembly includes machining the inner conductive path assembly and the outer conductive path assembly to form a machined inner conductive path assembly and a machined outer path assembly. Finally, forming the first assembly includes assembling the machined inner conductive path assembly and the machined outer conductive path assembly including an O-ring to provide seal between the inner path assembly and the outer path assembly.

In some embodiments, forming the non-bulkhead assembly including the two or more isolated non-bulkhead conductive paths includes assembling a conductive, flexible member and an inner conductive socket. Finally, forming the non-bulkhead assembly includes injection molding insulative material to provide insulation between the inner conductive socket and an outer socket.

In some embodiments, forming the flexible coupling between each of the two or more isolated bulkhead conductive paths and each of the two or more isolated non-bulkhead conductive paths to form the flexible connector includes coupling the conductive, flexible member to the substantially rigid inner conductor of the bulkhead assembly to form a bulkhead and non-bulkhead assembly. Further, forming the flexible coupling includes forming a flexible material around the inner conductive path. Finally, forming the flexible coupling includes assembling conductive braid over the flexible material and forming a flexible sleeve outside the conductive braid.

Figure 4:
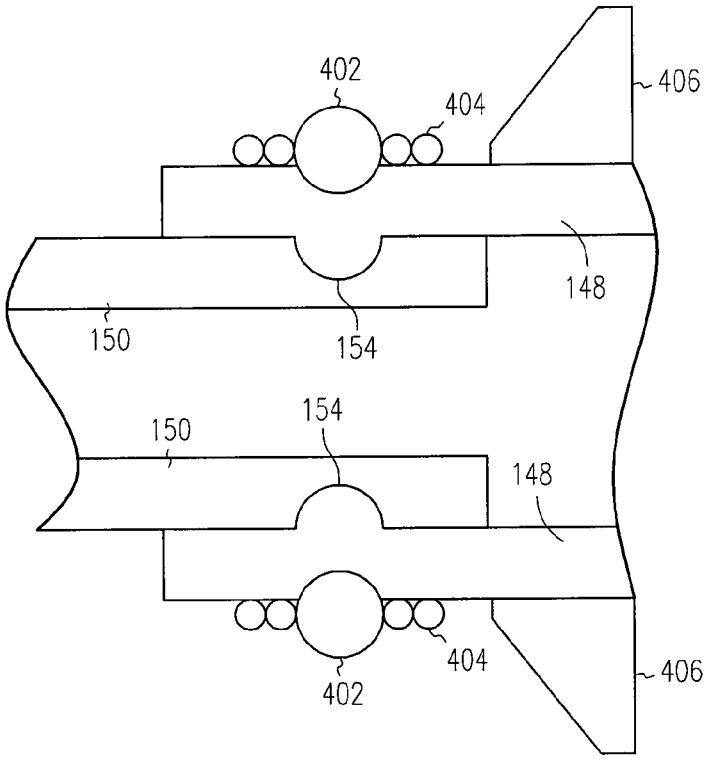
FIG. 4 is a detailed view of the substantially rigid member having the groove and the flexible member included in the connector, shown in FIG. 1, and a wire, solder, and a heatsink for controlling wicking of the solder into the braided flexible member, in accordance with some embodiments of the present invention.

FIG. 4 is a detailed view of the substantially rigid member 150 having the groove 154 and the flexible member 148 included in the connector 110, shown in FIG. 1, and a wire 402, solder 404, and a heatsink 406 for controlling wicking of the solder into the braided flexible member 148, in accordance with some embodiments of the present invention.

Figure 5:
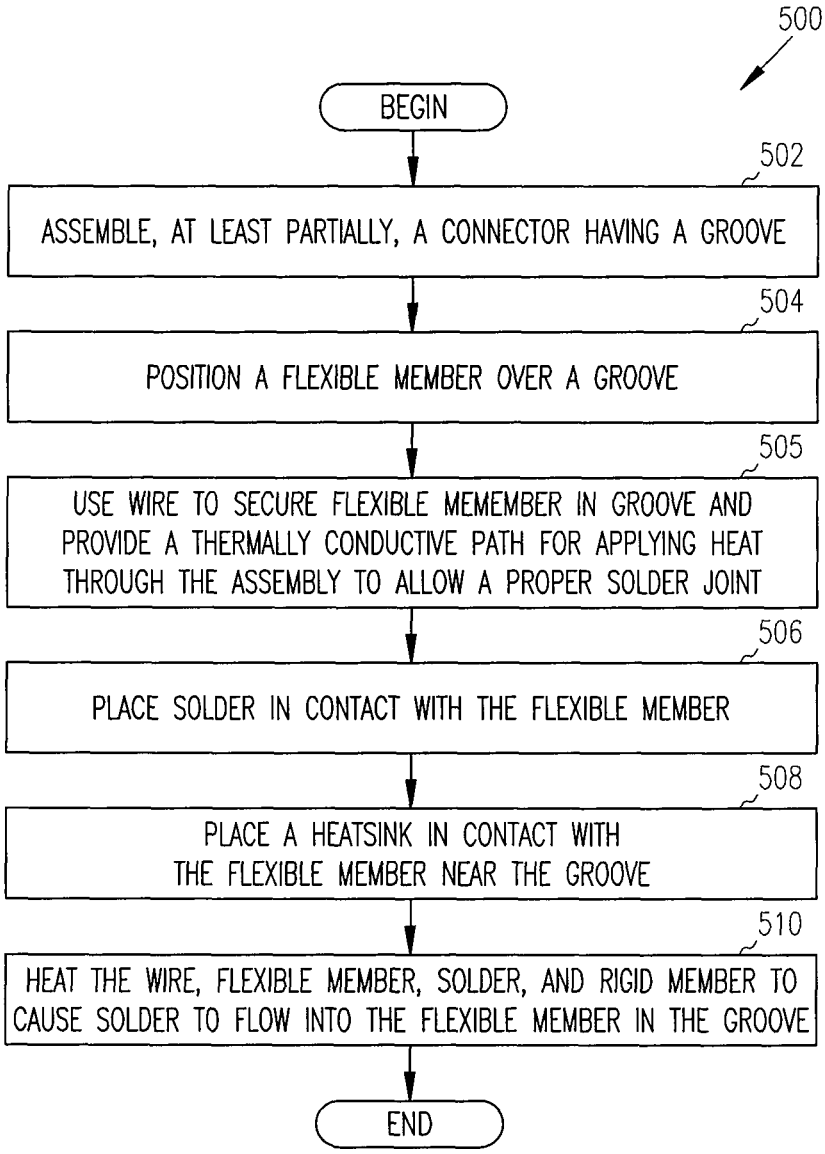
FIG. 5 is a flow diagram of a method for securing the flexible member, shown in FIG. 4, to the substantially rigid member, shown in FIG. 4, in accordance with some embodiments of the present invention.

FIG. 5 is a flow diagram of a method 500 for securing the flexible member 148, shown in FIG. 4, to the substantially rigid member 150, shown in FIG. 4, in accordance with some embodiments of the present invention. Referring to FIG. 1, FIG. 4, and FIG. 5, the method 500 includes assembling, at least partially, the connector 110, shown in FIG. 1, having the groove 154, shown in FIG. 4, (block 502), positioning the flexible member 148 over the groove 154 (block 504), using the wire 402 to secure the flexible member 148 in the groove 154 and provide a thermally conductive path for applying heat through the assembly comprising the wire 402, the flexible member 148, the solder 404 and the substantially rigid member 150 to allow a proper solder joint (block 505), placing the solder 404, shown in FIG. 4, in contact with the flexible member 148 (block 506), placing the heatsink 406, shown in FIG. 4, in contact with the flexible member 148 near the groove 154 (block 508), and heating the wire 402, the flexible member 148, the solder 404 and the substantially rigid member 150 to cause the solder 404 to flow into the flexible member 148 in the groove 154 (block 510).

In some embodiments, securing the flexible member 148 in the groove 154 includes wrapping the wire 402, shown in FIG. 4, in the groove 154 to secure the flexible member 148 between the wire 402 and the groove 154. In some embodiments, placing the solder 404 in contact with the flexible member 148 includes wrapping the solder 404 adjacent to the groove 154. In some embodiments, placing the heatsink 406 in contact with the flexible member 148 near the groove 154 includes placing the heatsink 406 adjacent to the solder 404. In some embodiments, heating the wire 402, the flexible member 148, the solder 404 and the substantially rigid member 150 to cause the solder 404 to flow into the flexible member 148 in the groove 154 includes heating the wire 402, the flexible member 148, the solder 404 and the substantially rigid member 150 by resistive heating. In some embodiments, heating the wire 402, the flexible member 148, the solder 404 and the substantially rigid member 150 by resistive heating includes generating a current in the flexible member 148. In some embodiments, heating the wire 402, the flexible member 148, the solder 404 and the substantially rigid member 150 to cause the solder 404 to flow into the flexible member 148 in the groove 154 includes heating the wire 402, the flexible member 148, the solder 404 and the substantially rigid member 150 using a heat source. In some embodiments, the flexible member 148 includes a conductive braid.

Figure 6:
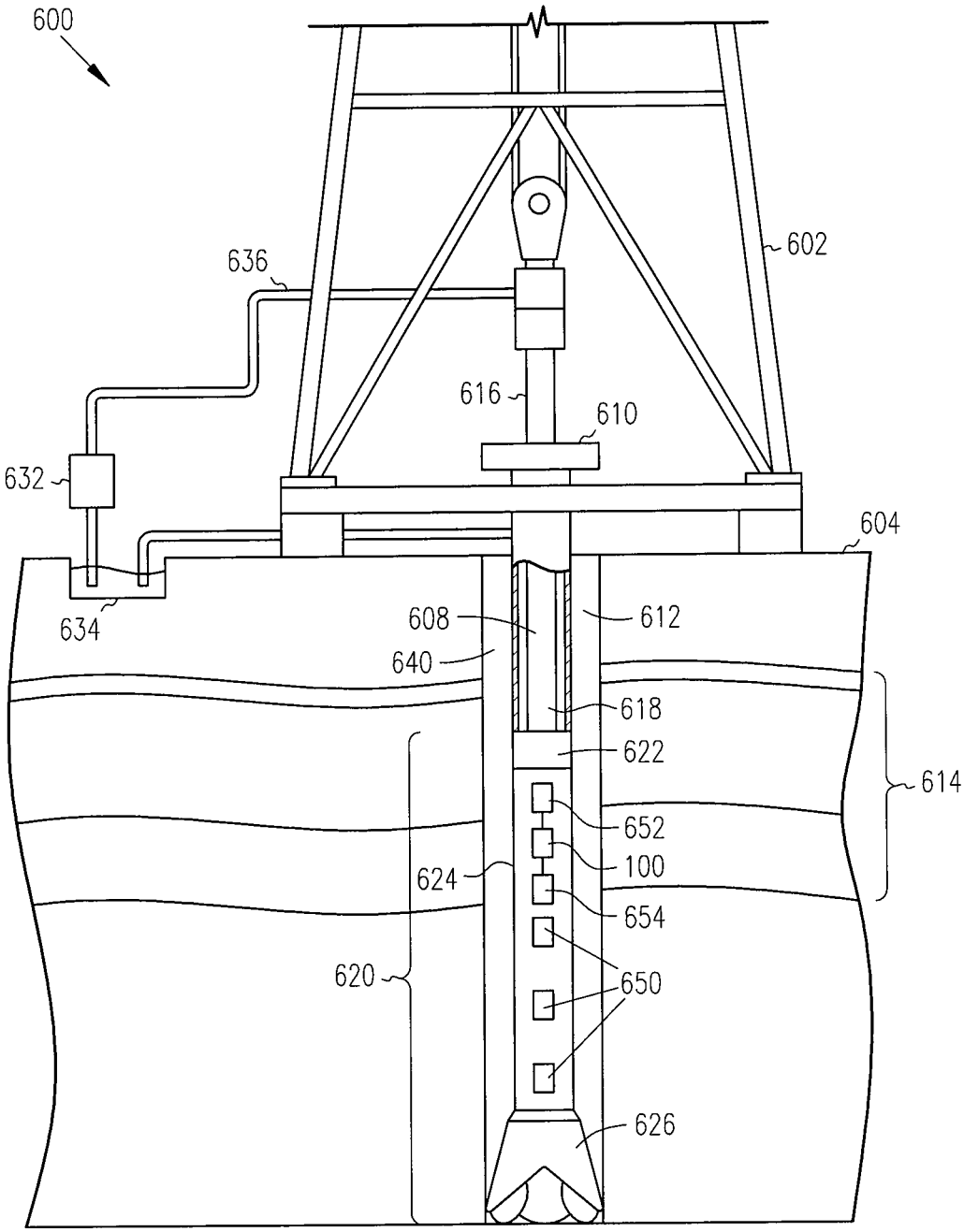
FIG. 6 illustrates a system for drilling operations, in accordance with some embodiments of the present invention.

FIG. 6 illustrates a system 600 for drilling operations in accordance with some embodiments of the present invention. The system 600 includes a drilling rig 602 located at a surface 604 of a well. The drilling rig 602 provides support for a drill string 608. The drill string 608 penetrates a rotary table 610 for drilling a borehole 612 through subsurface formations 614. The drill string 608 includes a Kelly 616 (in the upper portion), a drill pipe 618 and a bottom hole assembly 620 (located at the lower portion of the drill pipe 618). The bottom hole assembly 620 may include drill collars 622, a downhole tool 624 and a drill bit 626. The downhole tool 624 may be any of a number of different types of tools including measurement-while-drilling (MWD) tools, logging-while-drilling (LWD) tools, etc.

During drilling operations, the drill string 608 (including the Kelly 616, the drill pipe 618 and the bottom hole assembly 620) may be rotated by the rotary table 610. In addition or alternative to such rotation, the bottom hole assembly 620 may also be rotated by a motor (not shown) that is downhole. The drill collars 622 may be used to add weight to the drill bit 626. The drill collars 622 also may stiffen the bottom hole assembly 620 to allow the bottom hole assembly 620 to transfer the weight to the drill bit 626. Accordingly, this weight provided by the drill collars 622 also assists the drill bit 626 in the penetration of the surface 604 and the subsurface formations 614.

During drilling operations, a mud pump 632 may pump drilling fluid (known as "drilling mud") from a mud pit 634 through a hose 636 into the drill pipe 618 down to the drill bit 626. The drilling fluid can flow out from the drill bit 626 and return back to the surface through an annular area 640 between the drill pipe 618 and the sides of the borehole 612. The drilling fluid may then be returned to the mud pit 634, where such fluid is filtered. Accordingly, the drilling fluid can cool the drill bit 626 as well as provide for lubrication of the drill bit 626 during the drilling operation. Additionally, the drilling fluid removes the cuttings of the subsurface formations 614 created by the drill bit 626.

The downhole tool 624 may include one to a number of different sensors 650, which monitor different downhole parameters and generate data that is stored within one or more different storage mediums within the downhole tool 624. The type of downhole tool 624 and the type of sensors 650 thereon may be dependent on the type of downhole parameters being measured. Such parameters may include the downhole temperature and pressure, the various characteristics of the subsurface formations (such as resistivity, radiation, density, porosity, etc.), the characteristics of the borehole (e.g., size, shape, etc.), etc. In some embodiments, the downhole tool 624 includes electronic modules 652 and 654 coupled together by the pair of connectors 100, also shown in FIG. 1. Exemplary electronic modules 652 and 654 include acoustic measurement modules, gamma ray measurement modules, data acquisition modules, and data communication modules.

Reference in the specification to "an embodiment," "one embodiment," "some embodiments," or "other embodiments" means that a particular feature, structure, or characteristic described in connection with the embodiments is included in at least some embodiments, but not necessarily all embodiments, of the invention. The various appearances of "an embodiment," "one embodiment," or "some embodiments" are not necessarily all referring to the same embodiments.

If the specification states a component, feature, structure, or characteristic "may," "might," or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

Although specific embodiments have been described and illustrated herein, it will be appreciated by those skilled in the art, having the benefit of the present disclosure, that any arrangement which is intended to achieve the same purpose may be substituted for a specific embodiment shown. This application is intended to cover any adaptations or variations of the present invention. Therefore, it is intended that this invention be limited only by the claims and the equivalents thereof.

What is claimed is:

1. A method comprising:

forming a bulkhead assembly including two-or-more isolated bulkhead conductive paths;

forming a non-bulkhead assembly including two-or-more isolated non-bulkhead conductive paths; and forming a flexible coupling between each of the two-or-more isolated bulkhead conductive paths and each of the two-or-more isolated non-bulkhead conductive paths to form a flexible connector, wherein forming the flexible coupling includes forming a flexible sleeve substantially surrounding a flexible member, the flexible member separated from a conductive flexible member in the non-bulkhead assembly by a flexible insulative material.

2. The method of claim 1, wherein forming the bulkhead assembly including the two-or-more isolated bulkhead conductive paths comprises:

forming a first assembly including one of the two-or-more isolated bulkhead conductive paths, the one of the two-or-more isolated bulkhead conductive paths is an inner path;

forming a second assembly including one of the two-or-more isolated bulkhead conductive paths, the one of the two-or-more isolated bulkhead conductive paths is an outer path; and assembling the first and second assembly.

3. The method of claim 1, wherein forming the non-bulkhead assembly including the two or more isolated non-bulkhead conductive paths comprises:

assembling the conductive flexible member and an inner conductive socket; and injection molding insulative material to provide insulation between the inner conductive socket and an outer socket.

4. The method of claim 3, wherein assembling the conductive flexible member and the inner conductive socket comprises: coupling a spring to the inner conductive socket.

5. The method of claim 4, wherein coupling the spring to the inner conductive socket comprises coupling the spring to the inner conductive socket by crimping or by soldering.

6. The method of claim 1, wherein forming the bulkhead assembly comprises:

using beryllium copper.

7. The method of claim 1, wherein forming the bulkhead assembly comprises:

forming a torque member including an insulative material.

8. The method of claim 7, wherein forming the torque member including the insulative material comprises: using polyetherether-ketone as the insulative material.

9. A method comprising:

forming a bulkhead assembly including two-or-more isolated bulkhead conductive paths, comprising:

forming a first assembly including one of the two-or-more isolated bulkhead conductive paths, the one of the two-or-more isolated bulkhead conductive paths is an inner path;

forming a second assembly including one of the two-or-more isolated bulkhead conductive paths, the one of the two-or-more isolated bulkhead conductive paths is an outer path; and assembling the first and second assembly;

forming a non-bulkhead assembly including two-or-more isolated non-bulkhead conductive paths; and forming a flexible coupling between each of the two-or-more isolated bulkhead conductive paths and each of the two-or-more isolated non-bulkhead conductive paths to form a flexible connector, wherein forming the first assembly comprises:

injection molding an insulative material around the inner conductive path to form an inner conductive path assembly;

injection molding an insulative material around the outer conductive path to form an outer conductive path assembly;

machining the inner conductive path assembly and the outer conductive path assembly to form a machined inner path assembly and a machined outer path assembly; and assembling the machined inner path assembly and the machined outer path assembly including an O-ring to provide seal between the inner path assembly and the outer path assembly.

10. A method comprising:

forming a bulkhead assembly including two-or-more isolated bulkhead conductive paths;

forming a non-bulkhead assembly including two-or-more isolated non-bulkhead conductive paths, comprising:

assembling a conductive flexible member and an inner conductive socket; and injection molding insulative material to provide insulation between the inner conductive socket and an outer socket; and forming a flexible coupling between each of the two-or-more isolated bulkhead conductive paths and each of the two-or-more isolated non-bulkhead conductive paths to form a flexible connector, wherein forming the flexible coupling between each of the two or more isolated bulkhead conductive paths and each of the two or more isolated non-bulkhead conductive paths to form the flexible connector comprises:

coupling the conductive flexible member to a substantially rigid inner conductor of the bulkhead assembly to form a bulkhead and non-bulkhead assembly having an inner conductive path;

forming a flexible material around the inner conductive path;

assembling conductive braid over the conductive flexible material; and forming flexible sleeve outside the conductive braid.

* * * * *